US007330109B2

(12) United States Patent
Martin

(10) Patent No.: US 7,330,109 B2
(45) Date of Patent: Feb. 12, 2008

(54) SYSTEM AND METHOD FOR CAPTURING AND REROUTING AN INDIVIDUAL LOCAL SECURITY SYSTEM

(75) Inventor: Christopher D. Martin, Plainview, NY (US)

(73) Assignee: Honeywell International, Inc., Morristown, NJ (US)

( * ) Notice: Subject to any disclaimer, the term of this patent is extended or adjusted under 35 U.S.C. 154(b) by 108 days.

(21) Appl. No.: 11/107,612

(22) Filed: Apr. 15, 2005

(65) Prior Publication Data

US 2006/0232399 A1 Oct. 19, 2006

(51) Int. Cl.
*G08B 29/00* (2006.01)

(52) U.S. Cl. ..... 340/506; 340/521; 340/539.17

(58) Field of Classification Search ..... 340/506, 340/518, 521, 531, 532, 539.1, 539.16, 539.17, 340/825.22, 825.69, 505, 511; 370/37, 42
See application file for complete search history.

(56) References Cited

U.S. PATENT DOCUMENTS 4,654,638 A * 3/1987 Clift ..... 340/531
4,951,029 A * 8/1990 Severson ..... 340/506
5,408,217 A 4/1995 Sanderford, Jr. ..... 340/506
5,485,142 A * 1/1996 Stute et al. ..... 340/506
5,650,940 A * 7/1997 Tonozuka et al. ..... 709/224
5,977,871 A 11/1999 Miller et al. ..... 340/506
6,069,655 A 5/2000 Seeley et al. ..... 348/154
6,999,562 B2 * 2/2006 Winick ..... 379/42
7,042,349 B2 * 5/2006 Bergman et al. ..... 340/514
7,135,962 B2 * 11/2006 Durbin et al. ..... 340/425.5

OTHER PUBLICATIONS

Safewatch Pro® 3000EN, Entrepreneur 3000EN, Security Manager 3000EN, Security Systems, "Installation and Set-Up Guide", K5305V3, Jun. 2002, ADT Security Services, pp. i-16-9.

* cited by examiner

*Primary Examiner*—Van T. Trieu
(74) *Attorney, Agent, or Firm*—Scully, Scott, Murphy & Presser PC

(57) ABSTRACT

A method and system used by a central monitoring station to monitor and control a local installed security system. The method includes programming into a receiver an identifier for a local security system to be captured and controlled. Programming a control instruction for the local installed system into a receiver. Transmitting the control instruction to a local security system. The method and apparatus allows a central monitoring station to obtain control of an installed security system even in the case where ownership of the security system has changed hands and the identification number has changed. The apparatus includes a plurality of receivers and transmitters for transmitting information between the central monitoring station and a plurality of installed security systems, an automation computer for processing received messages from the installed security systems, and a configuration computer that configures and controls the installed local security systems.

25 Claims, 5 Drawing Sheets

SYSTEM AND METHOD FOR CAPTURING AND REROUTING AN INDIVIDUAL LOCAL SECURITY SYSTEM

BACKGROUND OF THE INVENTION

1. Field of the Invention

The invention relates generally to a monitoring system including a central monitoring station that receives signals, reports information from a number of different security systems at different locations, and that has the ability to control the different security systems. More specifically, the invention relates to a central monitoring station having the ability to control a local security system even after contact information has been modified.

2. Background

Security systems, such as for homes and businesses, have become commonplace as people seek to protect themselves and their property. A security system includes any life, safety, and property protection system. A security system typically includes a local security system and a central monitoring station. The local security system is connected to the central monitoring station using a communication link. A local security system typically includes a control panel that communicates with a number of sensors via a wired or wireless path. The control panel has the ability to notify local emergency services and/or a remote monitoring station of an alarm condition via a telephone dialer to a remote monitoring facility. A communication network device, such as a modem, allows the control panel to send and receive information via a communication link. The communication network is usually a telephone network and the communication link is a telephone line, however, the control panel can also send and receive information via a computer network, such as the Internet, or wireless network. Additionally, a cellular network or radio frequencies can be used.

The central monitoring station or remote facility is staffed with operators to monitor incoming communications and to determine if and when an alarm signal is set by a monitored security system. The operator contacts emergency services such as fire or police personnel in the appropriate municipality by telephone or by other means to report the alarm for anyone else on a contact list such as the homeowner.

In response to a received message, the remote facility processes the message and performs an action. The messages from the respective local security systems may include identifiers that identify the local security systems.

The remote facility includes receivers for communicating with different security systems via one or more networks. An automation computer is used to execute software instructions stored in the memory to achieve the desired functionality, including recovering the information and other data from the local security systems, and initiating transmissions to the security systems. A memory resource used for storing software or other instructions that are executed by the computer to achieve the functionality described herein may be considered a program storage device. The memory may also store data, e.g., for identifying which security systems are to be notified when an alarm or other specified event occurs at a given security system. Information for contacting each of the security systems is also stored. For example, when the remote facility and a security system communicate via a computer network, the remote facility may store an IP address of the security system. When the remote facility and a security system communicate via a telephone network, the remote facility may store a phone number of the security system as well as modem settings. In practice, the remote facility can have a number of computers with different interfaces to enable communication with a large number of security systems at the same time via different communication paths.

However, there is a need for a way for the central monitoring station or remote facility to be able to contact and control the individual local security systems if any contact information changes for the local security system. For example, if the phone number or the IP address of the local security system changes, there is no means for the central monitoring station to contact the local security system to update information.

BRIEF SUMMARY OF THE INVENTION

The present invention describes a solution that allows the central monitoring station to be able to update the contact information, to capture the local security system, and to reroute the security system, if necessary.

The invention enables a central monitoring station operator to program a monitoring receiver to capture an account or local security system when the local security system contacts the central monitoring station and to program the receiver to instruct the local security system to perform various functions.

One aspect of the invention includes a monitoring system for monitoring a plurality of local security systems that includes a means for capturing one or more local security systems and a means for reprogramming one or more functions of a captured local security system once that local security system is captured. This means for reprogramming includes a means for programming one or more preprogrammed messages.

The monitoring system further includes a means for programming one or more local security systems to be captured.

The monitoring system captures the local security system by transmitting a capture signal from a monitoring receiver to said local security system. This capture signal instructs that local security system to remain in contact with the receiver such that the local security system can receive a preprogrammed message.

The monitoring system further includes a means for determining whether a local security system has been programmed into a monitoring receiver indicating that the local security system should be captured as the captured local security system.

The monitoring system further includes means for transmitting one or more of the preprogrammed message to the captured local security system.

The monitoring system has several options for the preprogrammed message. The preprogrammed message can be an instruction to the local security system to download a new configuration computer identification number and to call-back the new configuration number. Additionally, the preprogrammed message can be an instruction to download new contact information such that the local installed security system is redirected to a different receiver. Furthermore, the preprogrammed message might be an instruction to shutdown a dialer or any part of a system at the local installed security system such that one or more local security systems cannot contact the receivers.

The monitoring system uses the preprogrammed messages to control the functions of the local security system. This control enables the security control system to control the flow of data and traffic into each monitoring receiver.

In another aspect of the invention, a monitoring receiver for monitoring and controlling local installed security systems includes a user interface means for inputting an identifier corresponding to a local security system that an operator desires to capture and for entering a plurality of messages to be transmitted to a captured local security system.

The monitoring receiver further includes a determination means for determining whether the identifier that is stored in a memory section corresponds to a local security system that is calling the monitoring receiver and a control section for capturing the local security system based upon a determination by the determination means. The control section transmits one of said plurality of messages to the local security system after capturing the local security system.

In another aspect of the invention, disclosed is a security system comprising a plurality of monitoring receivers attached to a plurality of local security systems. Each monitoring receiver can transmit a unique control signal to one of the local security systems such that the local security system remains in contact with one of the monitoring receivers. Each of the local security systems include a means for recognizing said unique control signal. Upon receipt of the unique control signal, the local security system remains connected to the monitoring receiver and receives a command from the monitoring receiver.

In order to recognize this unique control signal, the local security system can receive a control update from a remote location. The control update includes new configuration software. The control update is stored as a control panel configuration parameter in memory. Additionally, the control update software can be preinstalled prior to installation at an end users home or place of business.

The above and other features of the invention, including various novel details of construction and combinations of parts, will now be more particularly described with reference to the accompanying drawings and claims. It will be understood that the various exemplary embodiments of the invention described herein are shown by way of illustration only and not as a limitation thereof. The principles and features of this invention may be employed in various alternative embodiments without departing from the scope of the invention.

BRIEF DESCRIPTION OF THE DRAWINGS

These and other features, benefits and advantages of the present invention will become apparent by reference to the following text and figures, with like reference numbers referring to like structures across the views, wherein.

DETAILED DESCRIPTION OF THE INVENTION

Figure 1:
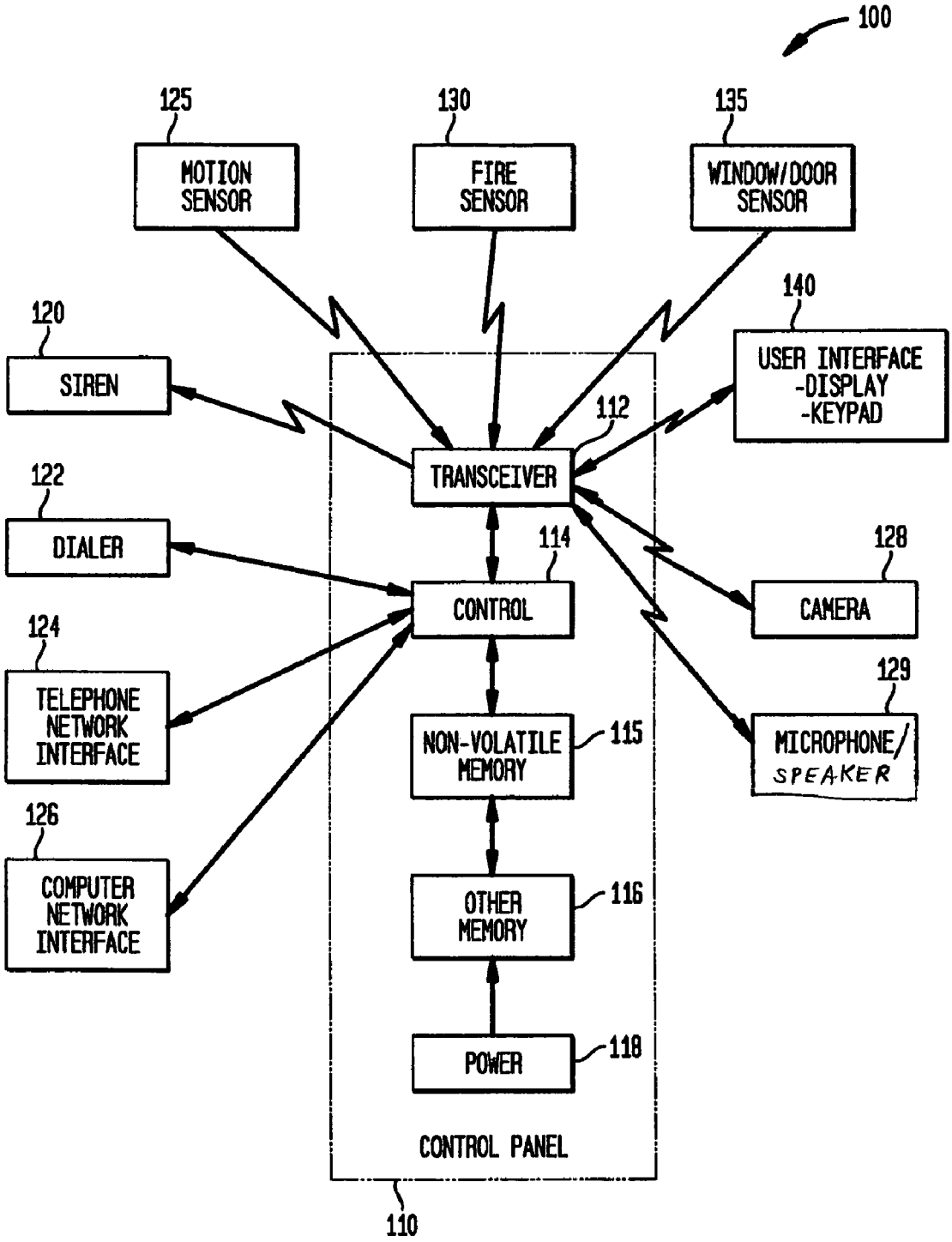
FIG. 1 illustrates an overview of the local installed security system according to the invention.

FIG. 1 illustrates a sample local installed security system. The local security system 100 includes a control panel 110 that communicates with a number of sensors via a wired or wireless path. For example, the control panel 110 may receive signals from motion sensors 125 that detect when a person enters a room. Signals received from fire sensors 130 indicate that a fire has been detected. Signals received from window and door sensors 135 indicate that a window or door has been opened.

The control panel 110 can include a user interface device 140 integrated with the control panel 110 or a separate peripheral device can be connected to the control panel 110. The user interface device 140 is commonly provided in the home such as by affixing it to a wall or placing it on a table, for instance, while the control panel 110 generally is a larger component that may be installed, e.g., in a closet or basement.

Signals received from a peripheral user interface device 140, such as a keypad and display, a combined display and touch screen, and/or a voice interface may arm and disarm the system. The user interface device 140 is the primary interface between the user and the security system 100. The user interface device 140 may include components that are similar to the control panel 110, including a control, memory, and power source.

The control panel 110 has the ability to notify local emergency services and/or a central monitoring station of an alarm condition via a telephone dialer 122. Furthermore, a telephone network interface 124, such as a modem, allows the control panel 110 to send and receive information via a communication link. A computer network interface 126 allows the control panel 110 to send and receive information via a computer network, such as the Internet. The computer network interface 126 may include an always-on interface, such as a DSL or cable modem, and a network interface card, for example. A dial-up telephone connection may also be used. Other communication paths such as long-range radio and a cellular telephone link may also be used. The dialer 122 and interfaces 124 and 126 are typically hardwired to the control panel 110 and activated by the control 114.

The control panel 110 includes a transceiver 112 for transmitting and receiving wireless signals. The control 114 includes a microprocessor that executes software, firmware, and micro-code or the like to implement logic to control the security system 100. The control panel 110 may include a non-volatile memory 115 and other additional memory 116 as required. A memory resource used for storing software or other instructions that are executed by the control 114 to achieve the functionality described herein may be considered a program storage device. A dedicated chip such as an ASIC may also be used. A power source 118 provides power to the control panel 110 and typically includes a battery backup to AC power.

The control panel 110 contains information regarding the local security system's 100 configuration. Information such as the local phone number, IP address, user ID codes, alarm zones, and a test report interval is stored in the memory area of the control panel 110. Panel configuration parameters are stored in the memory areas (115 and 116). For example, any initial configuration parameters can be stored in flash memory. Additionally, any new configuration parameters that are updated via an EEPPOM change, or updated via a flash update from a remote location and will be stored in memory. The software allows the control panel to achieve functionality in accordance with the configuration parameters stored in memory.

Figure 2:
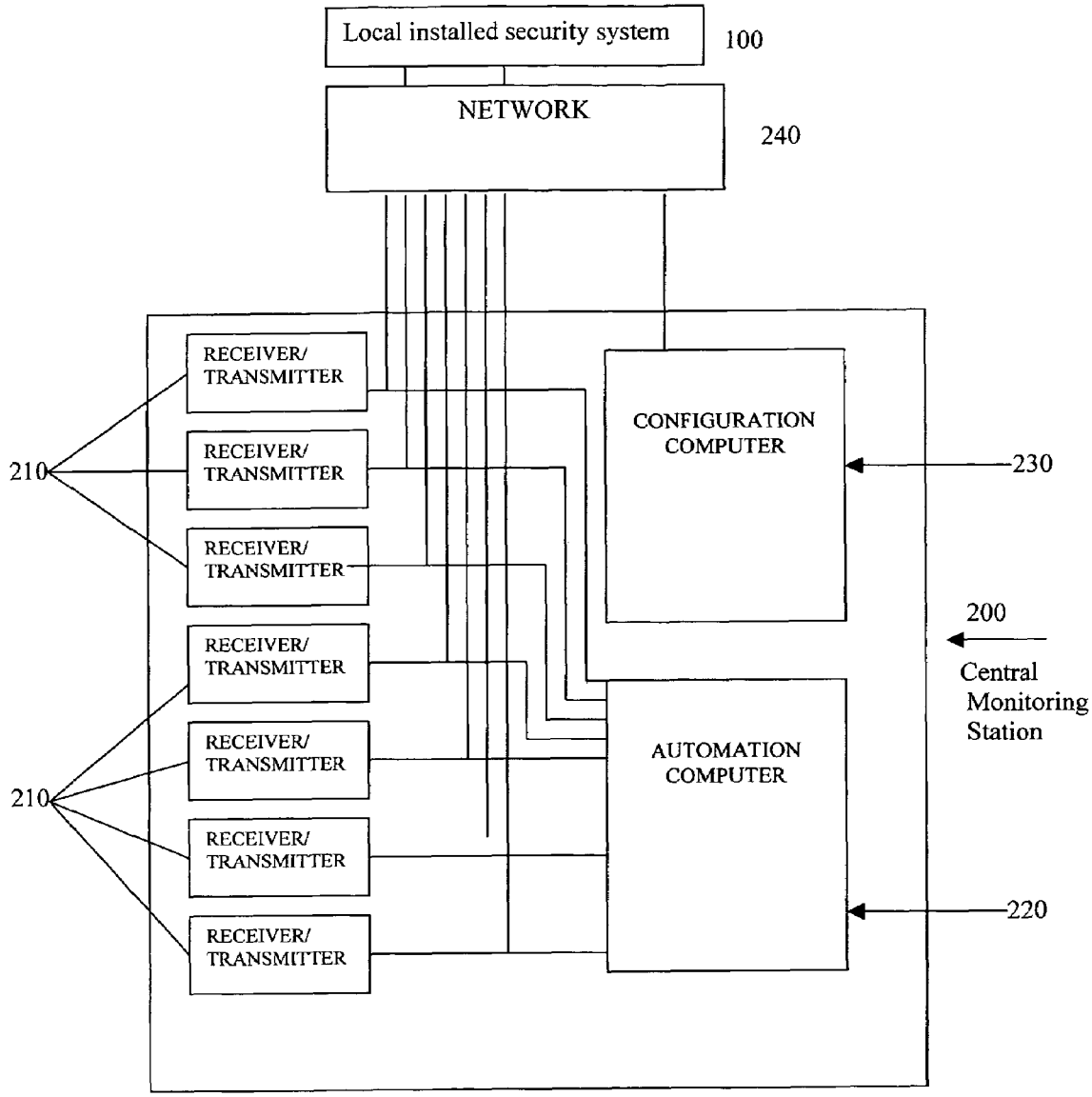
FIG. 2 illustrates the central monitoring station according to the invention.

FIG. 2 illustrates a central monitoring station that communicates with a plurality of local installed security systems. The central monitoring station 200 can include a configuration computer 230 that is programmed to upload and download control instructions and configuration parameter to the local installed security system configurations. The configuration computer 230 can also be used to arm, disarm, or check the status of the local security system 100. The central monitoring station 200 is typically provided at a staffed facility that is remote from the local installed security system 100 which it serves. The staff at the central monitoring station 200 monitors the alarm status of the different security systems and take appropriate actions such as notifying emergency personnel when an alarm is tripped.

The central monitoring station 200 is connected to at least one local installed security system 100 via a network or a communication link 240. The communication link can be any means that allows for bi-directional transmission of data. The communication link 240 can include essentially any type of communication path or paths, including a telephone link, such as a conventional telephone network, to communicate with the central monitoring station 200. Alternatively, the communication link 240 can be a modem. In another approach, the network 240 includes a computer network such as the Internet. For instance, the local installed security systems may use a communications protocol such as TCP/IP to communicate with the central monitoring station 200. Other communication paths such as satellite or RF radio paths, including, e.g., those using GSM or CDMA technique, may also be used. Moreover, the different local installed security systems 100 may use different communication paths, and upstream communications to the central monitoring station may be on different paths than downstream communication from the central monitoring station 200. In addition, local installed security systems 100 may use different communication paths, and upstream communications to the central monitoring station may be on different paths than downstream communication from the central monitoring station 200. In addition, the different communication paths may be attempted serially until a successful communication is made.

The central monitoring station 200 includes a plurality of receivers and transmitters 210 for communicating with different local installed security systems via one or more networks 240. The plurality of receivers and transmitters 210 are connected to an automation computer 220.

The automation computer 220 collects and processes signals received by the plurality of receivers 210 from the local installed security system 100. For example, if one of the motion sensors 125 connected to the control panel 110 at the local installed security system 100 is tripped, the control panel 110 will send a signal via a communication link or network 240 to one of said plurality of receivers 210. This alarm signal is then sent to the automation computer 220 for processing. The user at the central monitoring station 200 monitors the automation computer 220 and coordinates the proper response.

The configuration computer 230 is programmed with software to achieve the desired functionality, including initiating transmissions to the local installed security system 100.

The configuration computer 230 has a memory that contains identifying information for the individual local installed security systems. This information is the same as the information that is contained in the control panel 110. Information such as the local phone number, IP address, user ID codes, alarm zones, updating intervals.

The configuration computer 230 can be located at the central monitoring station 200, as depicted in FIG. 2 however; the configuration computer 230 can be located at any remote location capable of being connected to a network.

Further, the configuration computer 230 has a different and completely separate identification number from any of the plurality of receivers' identification numbers. Each of the plurality of receivers 210 has a primary and secondary identification number which is usually a telephone number or IP address in which the local installed security system 100 calls to transmit information to the central monitoring station 200. The secondary number is used in case the primary number is busy. The receiver identification number or numbers is a unique number that is only assigned to that particular receiver.

Similarly each local installed security system 100 is identified by a unique identification number which the plurality of receivers 210 or the configuration computer 230 uses to contact the local installed security system 100. If any of the information stored in the said control panel 110 is modified, the central monitoring station must be updated to include the modifications. This is especially important if an installed security system 100 changes ownership and the contact information changes, i.e. phone number, modem ID number or Internet address. If the central monitoring station is not updated, the automation computer 220 or the configuration computer 230 has no way of contacting the local installed security system 100.

Specifically, if either the central monitoring station 200 or the local installed security system 100 desires to transmit a message, signal or a command to the other, the transmitting party would need to have the receiving parties' identification number. Without this number, the party cannot contact the other system. For example, if a homeowner changes the phone number, the central monitoring station will be unable to contact the local installed security system. However, the local installed security system 100 will be able to contact the central monitoring station 200.

By means of operation of the method according to the invention, the operator at the central monitoring station 200 will be able to capture the local installed security system 100 such that the system will be forced to implement a commanded activity.

Accordingly, the advantage of the present invention is that when an individual local installed security system 100 calls and checks-in with a central monitoring station 200, the central monitoring station 200 will be able to maintain connection with the local installed security system such that the central monitoring station will be able to instruct the local installed security station 100 to respond to various predetermined commands.

In order to capture a local installed security system 100, the operator must program one of the plurality of receivers 210 to capture the system. By entering either the individual subscriber number or identification number into the plurality of receivers, the plurality of receivers 210 can be programmed to capture the local installed security system 100. A unique handshake signal will be transmitted to the local security system 100 to tell the local security system 100 to standby to receive at least one instruction from the receiver 300.

The local installed security system 100 includes a program installed in the control panel 110 that allows the local security system 100 to recognize this unique handshake signal. This program will also configure the control panel 110 to remain in contact with the monitoring receiver 300 upon receipt of the unique handshake signal. The control panel 110 will be able to receive new instructions from the receiver in a digital format. Additionally, the program will include control information that allows the control panel 110 to execute instructions sent from the receiver 300 after the control panel receivers the unique handshake signal and instruction. The control panel will then store the new instructions in memory.

This program or software package can be installed into the control panel 110 at the time of installation or when manufactured. Alternatively, the program can be uploaded to the control panel 110 from a remote location after installation.

Figure 3:
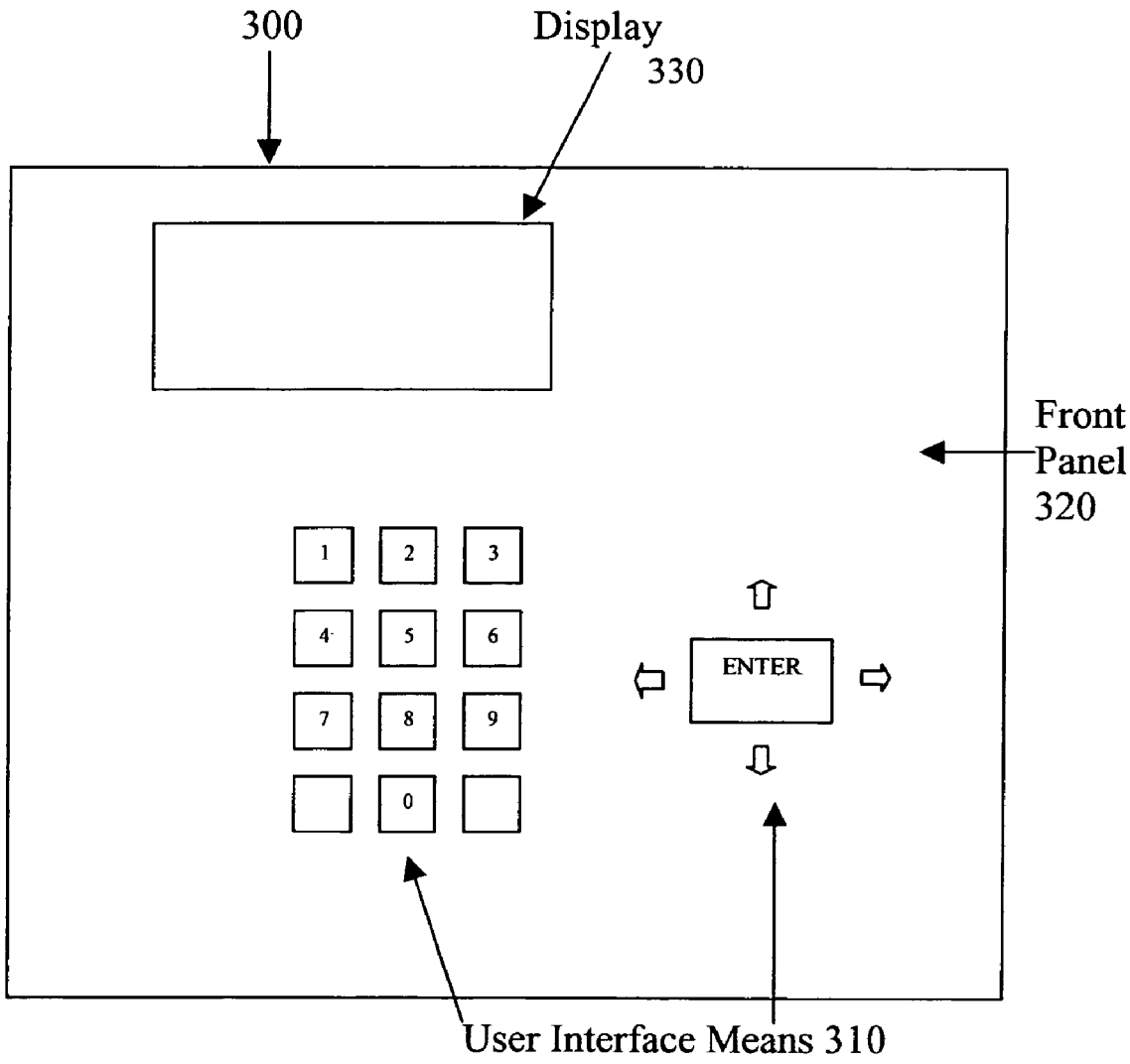
FIG. 3 illustrates an example of one of the plurality of receivers, which is located at the central monitoring station.
Figure 4:
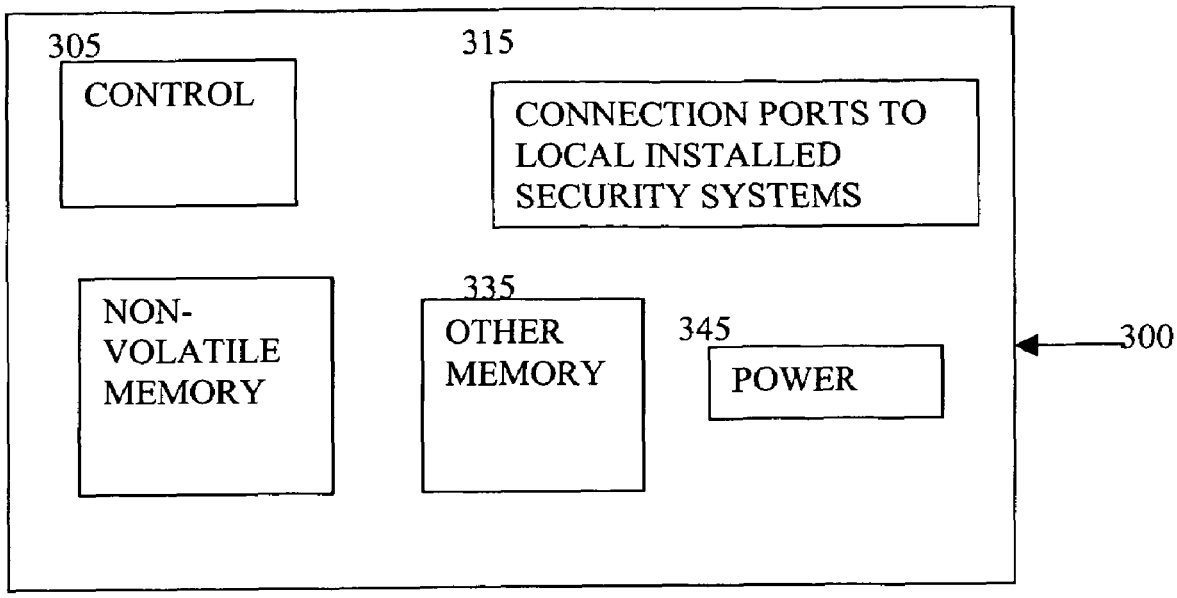
FIG. 4 illustrates some internal features located in the example of one of the plurality of receivers.

FIG. 3 illustrates the front of a sample receiver that can be programmed to capture a local installed security system 100. Receiver 300 includes a user interface means 310 located on the front panel 320 of the receiver, a display 330 for displaying user entered information and programming options. FIG. 4 depicts some of the internal elements of the sample receiver. Specifically, the receiver 300 includes a non-volatile memory section 325 or main memory which is programmable other memory 335, a power source 345, and a plurality of connection ports 315 which connect the receiver to a plurality of remote local installed security systems 100. The main memory section 325 stores any programmed information by the operator and preprogrammed control instructions. Receiver 300 further includes a control section 305 for processing instructions received by the receiver 300 and stored in main memory 325 and processing preprogrammed control instructions. The control section 305 can be a control circuit, a CPU or any known processing device.

To program the receiver 300, the central monitoring station operator enters the subscriber account number or identification number as an identifier using the user interface means 310, and the number will be displayed on a display 330. The receiver 300 will prompt the central monitoring station operator to confirm the subscriber account number or identification number based upon viewing the number on the display 330. The operator uses the user interface means 310 to confirm the number.

After an identifier is entered, the operator can enter a specific command that the operator would like the local installed security system 100 to carry out. The entered subscriber account number will be stored in non-volatile memory 325 in the receiver 300. The operator inputs the command into the receiver 300 using the user interface means 310. For example, one of the commands could be to instruct the local installed security system 100 to hang up and immediately call back using its programmed central station configuration computer number. Each local installed security system 100 may have a central station configuration computer number programmed into the control panel 110 at installation. This is the number which enables the control panel 110 to dial or connect the configuration computer 230. Once the control panel 110 for the local installed security system 100 is connected to the configuration computer 230, the configuration computer 230 can upload new parameters and configurations for the control panel 110 for the local installed security system 100.

The configuration computer 230 can upload software to the local installed security system 100 to change its behavior, identification information and other pre-programmed behaviors.

For example, the configuration computer 230 can change the test report interval or the primary and secondary call-in receiver numbers. In addition, the configuration computer 230 can remotely arm and disarm a local installed security system 100.

Another example of a command that an operator can program into the receiver 300 is to instruct the control panel 110 to download a new configuration computer identification number, and once the number is downloaded, to call-back a new configuration computer using the new identification number.

Additionally, the operator can program the receiver 300 to instruct the control panel 110 at the local installed security system 100 to download a new primary and secondary phone number and/or a new account number. This will allow the operator to redirect the local installed security system to a different receiver. This provides the advantage in controlling the traffic flow into and out of the central monitoring station 200 and the plurality of receivers 210. This also is a viable option for a central monitoring station operator where the owner of the local installed security system 100 is a nonpaying subscriber and where the central monitoring station 100 cannot simply ignore the alarm. This will allow the operator to redirect the local installed security system 100 to a lesser-used receiver or a receiver used specifically for nonpaying subscribers.

Furthermore, the present invention allows the operator to program the receiver 300 to shutdown at least a portion of the local installed security system 100 or to disable a periodic test report sent to the central monitoring station 200. Once again, this is an advantage in controlling the flow of information into and out of the central monitoring station 200 and is particularly useful for minimizing the flow of information from or to a local installed security system 100 where the owner is a nonpaying subscriber.

Once all of the commands have been entered into the receiver 300 for a specific local installed security system 100, the process is repeated for each local installed security system 100 that the operator desires to capture.

As mentioned above, each of the programmed commands are entered into the receiver 300 via the user interface means 310 on the front of the receiver 300 and stored in main memory 325. However, it is within the scope of the invention to instruct the receiver 300 to capture and redirect a local installed security system 100 remotely using a remote computer attached to the receiver using any known communication link. For example, the receiver 300 can receive an instruction from a main server computer located at a remote facility to capture the local installed security system 100. The main server computer acts as an intermediary between the receiver 300 and the local installed security system and is connected to each via a network or radio frequency.

Furthermore, an example of a user interface 310 according to the preferred embodiment of the invention can be an alphanumeric keypad.

Figure 5:
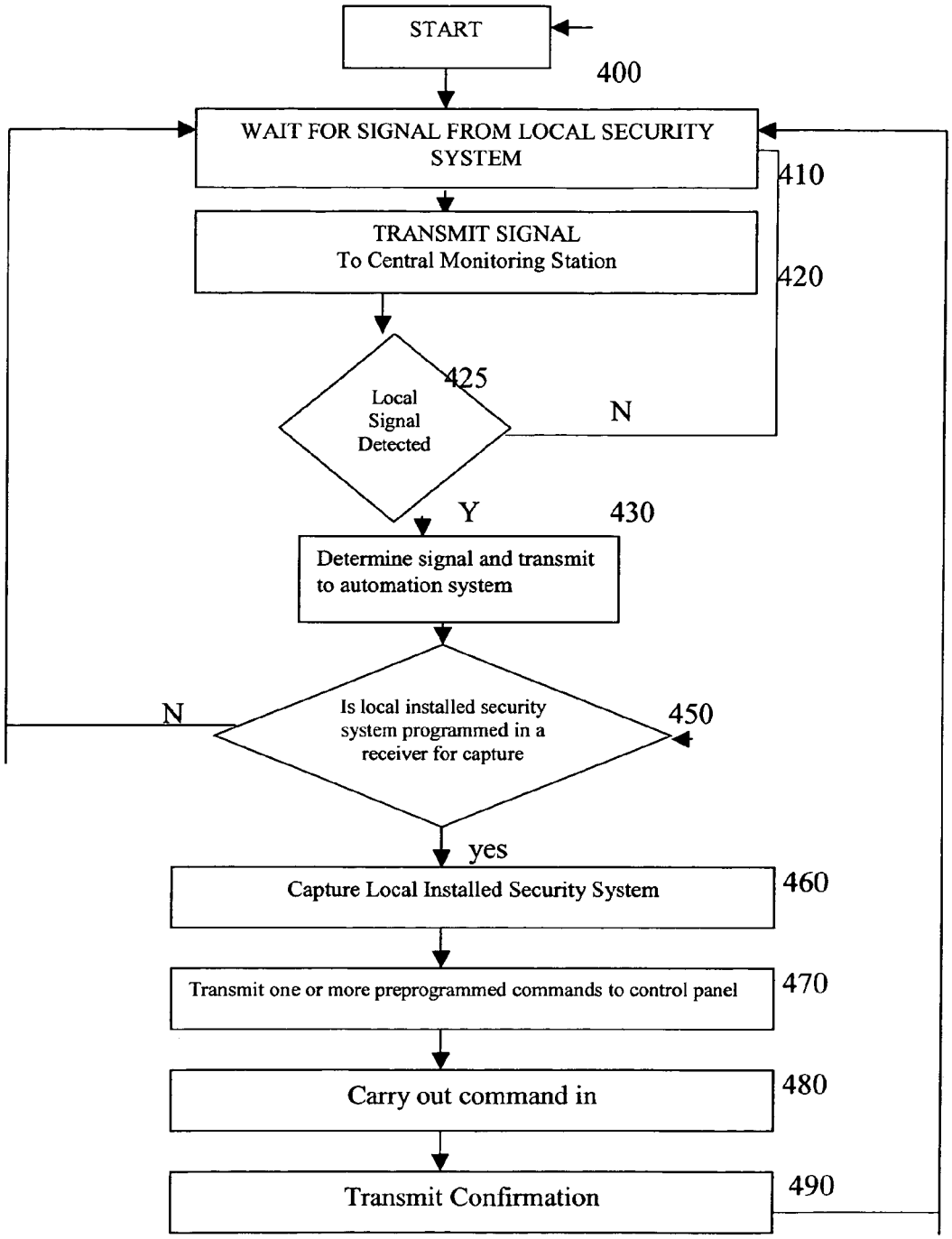
FIG. 5 illustrates the capturing method according to the invention.

FIG. 5 illustrates a method used by the present invention to capture and transmit command information. The process begins at block 400. At block 410, the receiver waits for a test signal, alarm report or any signal from the local installed security system 100 to the central monitoring station 200. Generally, a local installed security system transmits a "periodic test report" to the receiver 300. A "test report" is used to test that the communications between the local security system and receiver is good. This test signal can be transmitted using the dialer 122 at the control panel 110. When using the dialer 122, the periodic test report is transmitted to the receiver 300 at a predefined that report interval which can be set at installation or uploaded from the configuration computer.

The predefined test report interval is a period of time between each test report. For example, the test report interval can be every day, once a week, once a month, etc. The configuration computer 230 at the central monitoring station 200 can modify the test report interval. For example, if the traffic is particularly heavy, the configuration computer can increase the update period.

If, on the other hand, the local security system is transmitting the test reports via an Internet network or a wireless network, the predefined test report interval can be as frequent as every five minutes or less or eliminated entirely.

At block 420 the control panel 110 transmits the status of the local installed security system 100 to the plurality of receivers 210 at the central monitoring station 200 via the communication link or network 240. At block 425 the automation computer 220 monitors the plurality of receivers 210 to check if a local user status was received by the plurality of receivers 210. If the automation computer 220 detects a status signal from the control panel 110, then the automation computer 220, at block 430 determines the status and notifies the central monitoring station operator. If no status signal is detected, then the process proceeds to block 450.

At block 450 the control section 305 at one of the plurality of receivers 210 determines if the local installed security system which is transmitting a status report or any other signal has been programmed in one of the plurality of receivers 210 for capture. The control section 305 compares the subscriber account number or identification number of the local installed security system with a list of pre-programmed subscriber account numbers or identification numbers stored in main memory 325 of the receiver 300. If it is determined that the local installed security system 100 has been programming into one of said plurality of receivers 210 for capture, i.e., a match, the control section 305 instructs the receiver 300 to issue an instruction to the local installed security system to maintain a connection at block 460. This message is transmitted via the network 240. The instruction can be in the form of a modified kiss-off tone or signal.

Once the control panel 110 for the local installed security system 100 is captured or remains connected, one of a preprogrammed command messages is automatically transmitted by the receiver to the local installed security system at block 470. Alternatively, the operator at the central monitoring station can be notified that the local security system has been captured and then transmit a command to the captured local security system. The local installed security system 100 receives the command message and at block 480 carries out the command. At block 490 the control panel 110 can transmit a confirmation signal that the command was received from the central monitoring station 200.

The command message can also be displayed on a display means of the user interface 140.

If it is determined that the subscriber account number corresponding to the local installed security system has not been programmed in any of the plurality of receivers 210 to be captured, then the central monitoring station receiver issues a kiss-off tone or other acknowledgement signal indicating that the control panel 110 should hang up. The process proceeds back to block 410.

The invention has been described herein with reference to a particular exemplary embodiment. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A method of controlling an installed security system that is reporting to a central monitoring station where each installed security system is identified by an individual security system identifier, the method including the steps of:

programming one or more individual security system identifiers into a receiver, said one or more individual security system identifiers are a subset of all of the individual security system identifiers that report into the receiver;

capturing one of said one or more of installed security systems when said one individual security system reports into said central monitoring station; and transmitting at least one preprogrammed message to a captured installed security system.

2. The method of claim 1, wherein the step of programming said one or more individual security system identifiers further comprises the steps of:

navigating through a series of menus using a user interface means;

selecting from said series of menus a capture option; and entering said one or more individual security system identifiers into the receiver.

3. The method of claim 1, further comprising the step of:

receiving a signal from one or more installed security system said signal including a report regarding the one or more installed security system; and responding to said report prior to capturing said one or more installed security system.

4. The method of claim 1, wherein the step of capturing one or more installed security system, further comprises:

sending a capture signal to said one or more installed security system, said capture signal being distinct from a standard handshake signal transmitted when a installed security system reports in said central monitoring station; and receiving said capture signal from the central monitoring station wherein said one or more installed security system remains connected to one of a plurality of receivers in response to said capture signal.

5. The method of claim 1, wherein the step of transmitting at least one preprogrammed message occurs after said one or more installed security system is captured.

6. The method of claim 1, wherein said preprogrammed message is an instruction to said one or more local security system to download a new configuration computer identification number and to callback the central monitoring station using said new configuration number.

7. The method of claim 1, wherein said preprogrammed message is an instruction to download new contact numbers such that the installed security system is redirected to a different receiver.

8. The method of claim 1, wherein said preprogrammed message is an instruction to shutdown at least a portion of the one or more installed security system such that said one or more installed security system cannot contact a receiver.

9. The method of claim 1, further comprising the step of:

entering a plurality of preprogrammed messages into one of a plurality of receivers.

10. The method of claim 9, wherein the step of entering said plurality of predetermined messages include for each of said plurality of predetermined messages:

entering said preprogrammed message into one of a plurality of receivers using a user interface means.

11. The method of claim 1, further comprising the step of determining whether said local security system has been programmed into said receiver in the programming step indicating that said local security system should be captured.

12. The method of claim 1, wherein said at least one preprogrammed message is displayed on a display means of a user interface of said installed security system.

13. A monitoring system for monitoring and controlling a plurality of local security systems comprising:

means for capturing one or more local security system;

means for reprogramming one or more functions of a captured local security system; and means for programming one or more local security system to be captured, said one or more local security system being a subset of all local security system reporting into a receiver.

14. The monitoring system according to claim 13, wherein said means for capturing said one or more local security system includes a capture signal transmitted from a receiver to said local security system said capture signal being distinct from a standard handshake signal transmitted when a local security system contacts a receiver.

15. The monitoring system according to claim 13, wherein said means for reprogramming includes a means for programming one or more preprogrammed messages.

16. The monitoring system according to claim 15, wherein said preprogrammed message is an instruction to said one or more local security system to download a new configuration computer identification number and to call-back said new configuration number.

17. The monitoring system according to claim 15, wherein said preprogrammed message is an instruction to download new contact information such that the local installed security system is redirected to a different receiver.

18. The monitoring system according to claim 15, wherein said preprogrammed message is an instruction to shutdown at least a portion of the local installed security system such that said one or more local security system cannot contact said plurality of receivers.

19. The monitoring system according to claim 13, further comprising means for determining whether a local security system has been programmed into a receiver indicating that said local security system should be captured as the captured local security system.

20. The monitoring system according to claim 19, further comprising:

means for transmitting one or more of said preprogrammed message to said captured local security system.

21. A monitoring receiver for monitoring and controlling local installed security systems comprising:

user interface means for inputting an identifier corresponding to a local security system that an operator desires to capture and for entering a plurality of messages to be transmitted to a captured local security system said local security system being a sub-set of all of the local security systems that report to a receiver;

determination means for determining whether said identifier stored in a memory section corresponds to a local security system that is calling said receiver; and control section for capturing said local security system based upon a determination by said determination means.

22. The monitoring receiver according to claim 21, wherein said control section transmits one of said plurality of messages to said local security system after capturing said local security system.

23. A local security system device comprising: a processor for executing computer-readable program code provided on computer-readable storage medium, the computer-readable program code having instructions which causes said processor to execute the following steps:

receiving a unique control signal from a remote monitoring receiver said unique control signal being distinct from a standard control signal that is transmitted when a local security system initiates a contact with a remote monitoring receiver;

remaining in contact with said remote monitoring receiver upon receipt of said unique control signal;

receiving at least one instruction from said remote monitoring receiver; and executing said at least one instruction which is received from said remote monitoring receiver.

24. The local security system of claim 23 wherein said computer-readable program code is remotely uploaded to said local security system from a central monitoring station.

25. A computer program product comprising a computer usable storage medium having computer-readable program code embodied in the medium for controlling a processor in a local security system, the computer-readable program code comprising:

program code for receiving a unique control signal from a remote monitoring receiver said unique control signal being distinct from a standard control signal that is transmitted when a local security system initiates a contact with a remote monitoring receiver;

program code for remaining in contact with said remote monitoring receiver upon receipt of said unique control signal;

program code for receiving at least one instruction from said remote monitoring receiver; and program code for executing said at least one instruction which is received from said remote monitoring receiver.

* * * * *